United States Patent [19]

Little

[11] 4,080,129

[45] Mar. 21, 1978

[54] WHEEL MOUNTED INVERTIBLE MOLDS

[76] Inventor: Philip Andrew Little, 235 Brunswick Street, Fortitude Valley, Queensland, Australia

[21] Appl. No.: 691,482

[22] Filed: Jun. 1, 1976

[30] Foreign Application Priority Data

May 29, 1975 Australia ..... PC1799

[51] Int. Cl.[2] ..... B28B 7/08

[52] U.S. Cl. ..... 425/85; 249/81; 249/137; 425/62; 425/214; 425/439; 425/446; 425/454

[58] Field of Search ..... 425/62, 439, 453–454, 425/85, 446, 445, 214; 249/137, 79–81; 34/218

[56] References Cited

U.S. PATENT DOCUMENTS

| | | | |
|---|---|---|---|
| 153,020 | 7/1874 | Rowland | 425/445 |
| 1,574,565 | 2/1926 | Ferguson | 425/439 |
| 1,575,391 | 3/1926 | Stanton | 425/62 |
| 1,914,740 | 6/1933 | Greene | 425/453 |
| 2,954,596 | 10/1960 | Fassauer et al. | 425/62 |
| 2,975,470 | 3/1961 | Snelsow et al. | 425/85 |

*Primary Examiner*—Francis S. Husar
*Assistant Examiner*—John McQuade
*Attorney, Agent, or Firm*—Donald D. Jeffery

[57] ABSTRACT

For casting large concrete articles, a wheel-mounted main frame supports a mould assembly which can be rotated about a horizontal axis, and also raised and lowered. This assembly has two main mould sections oppositely arranged so that when one faces upwards the other faces downwards. A removable mould section fitted to each main mould section forms a complete mould capable, when uppermost, of receiving concrete to be cast. The mould assembly may then be inverted and lowered to a support, and the removable mould section disconnected to serve as a pallet for the cast article. The mould assembly may be raised, concrete may be cast in the other mould, which is uppermost, and the main frame may be moved clear of the deposited cast article.

7 Claims, 11 Drawing Figures

WHEEL MOUNTED INVERTIBLE MOLDS

BACKGROUND OF THE INVENTION

This invention relates to apparatus for casting concrete articles.

The manufacture of large concrete prefabricated structural units for use in building constructions, although resulting in many economies in building, does present considerable problems as the manufacture of these large units in normally very slow and involves much capital outlay, as does the transport of these units, when manufactured, to the building site.

SUMMARY OF THE INVENTION

The present invention has been devised with the general object of providing apparatus by means of which large units may be cast of concrete or other material with considerable savings of time and labour. Another object achievable in preferred embodiments of the invention is to provide such apparatus which may be of compact and readily transportable form, so that it may be set up at or near to a building site for the production of the units close to the place where they are to be erected to form a building.

With the foregoing and other objects in view, the invention resides broadly in apparatus for casting articles of concrete including a main frame; a mould assembly mounted on the main frame for rotation about a substantially horizontal axis and also for vertical movement so that the said assembly may be inverted, raised and lowered; a main mould section in the mould assembly; a movable mould section attachable to the mould assembly to form, with the main mould section, a mould which is adapted when uppermost, to receive concrete to be cast, the removable mould section being adapted, when inverted, lowered to a support and detached from the mould assembly, to serve as a pallet supporting the cast article. Preferably the mould assembly is double-sided with two oppositely arranged main mould sections, a removable mould section being applicable to each so that with each rotational reversal of the mould assembly one mould is brought to uppermost position for receiving the concrete to be cast, the other mould being brought to lowermost position for discharging the concrete cast therein. The main frame is preferably wheel mounted or otherwise mobile so that it may be moved to discharge cast articles more or less adjacently. Other features of the invention will become apparent from the following description.

BRIEF DESCRIPTION OF THE DRAWINGS

A preferred embodiment of the invention is shown in the accompanying drawings, wherein.

DETAILED DESCRIPTION OF THE PREFERRED EMBODIMENT OF THE INVENTION

Figure 1:
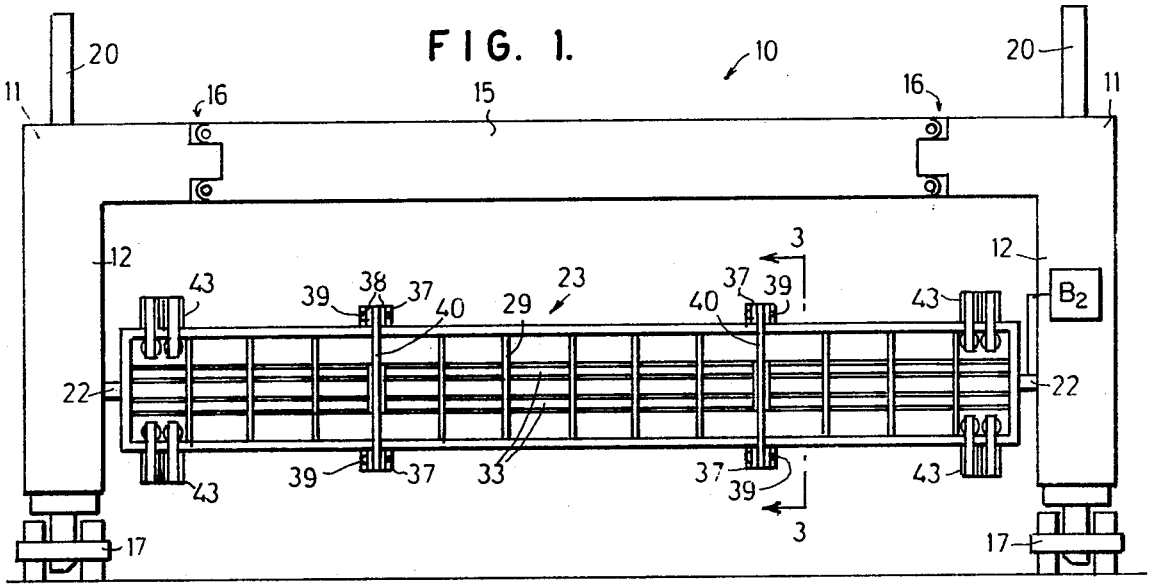
FIG. 1 is a side elevation of apparatus according to the invention.
Figure 2:
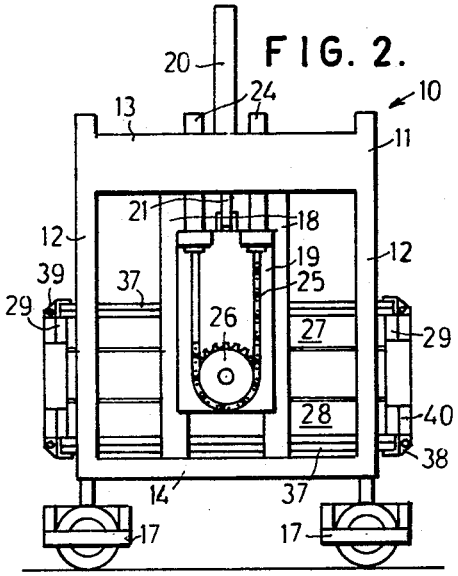
FIG. 2 is an end elevation of the apparatus.

The apparatus illustrated is for the purpose of making the parts of a prefabricated building unit consisting of a roof section and a floor section, both rectangular in plan view, the two sections being rigidly interconnected by central columns at both ends. The apparatus includes a main frame 10, consisting of two generally similar end frames 11, each with two vertical legs 12 rigidly interconnected by a pair of top cross-members 13 and a pair of bottom cross-members 14. The two end frames 11 are rigidly interconnected by two horizontal longitudinal members 15, the end portions of which are fixedly secured to the legs 12, the main middle parts of these members 15 being detachably secured to the end portions at 16, so that the main frame may be dismantled for transport.

Each leg 12 of the main frame is mounted upon a two-wheel axle 17, pivotal about a vertical axis and steerable by any suitable means (not shown). The axles may be turned through right angles from the position shown so that the main frame may be drawn as a trailer by a suitable towing vehicle; but during manufacture of the concrete units the axles are in the position illustrated so that the main frame may be moved laterally, in parallelism, the wheels travelling along concrete or other suitable horizontal tracks, and for this purpose a hydraulic drive (not shown) is provided for the wheels of at least one axle of each end frame.

The hydraulic system for the apparatus is not shown in the drawings, but is of any suitable known type, including an engine, pump, tank, control console and associated parts mounted on one of the end frames 11.

Each of the end frames 11 includes a pair of vertical guides 18 between which a pivot bearing block 19 is vertically slidable and may be raised or lowered by a hydraulic cylinder 20 mounted between the top cross members 13, its downwardly extending piston 21 being secured to the block 19.

The pivot bearing blocks 19 of the two end frames 11 both have bearings for the ends of a longitudinal tubular pivot 22 which passes through, and is secured centrally in, a mould assembly 23. By operation of the two hydraulic cylinders 20, which are connected for operation in unison, the mould assembly may be raised or lowered in parallelism. The mould assembly may also be rotated in one direction or the other through 180° by a pair of double-acting hydraulic cylinders 24 mounted on one of the pivot bearing blocks 19, their pistons being connected to the ends of a chain 25 engaging a sprocket 26 bolted coaxially to an end of the tubular pivot 22.

Figure 3:
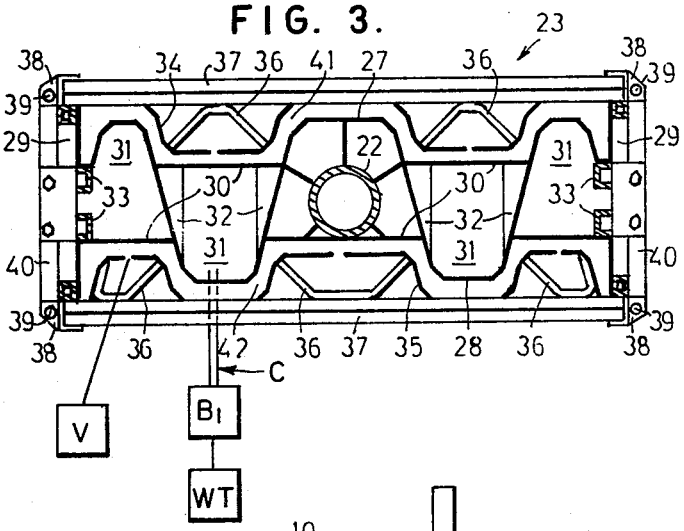
FIG. 3 is a sectional view along line 3—3 in FIG. 1, and FIGS. 4, 5, 6, 7, 8, 9, 10 and 11 are schematic cross-sectional views of the apparatus showing different stages in the casting of two somewhat different types of concrete structures according to the invention.

The mould assembly 23 is a box-like assembly and is double-sided, having a first main mould section 27 and a second main mould section 28, the two being oppositely arranged so that when, as shown in FIG. 3, the first main mould section 27 is in upwardly-facing position, the second main mould section is in inverted downwardly-facing position. The construction and arrangement of the two main mould sections is of a generally longitudinally corrugated sheet metal structure between two rigid side frames 29 and with transverse webs 30 bridging troughs of the corrugations so that several longitudinal passages 31 are formed through the assembly, which is reinforced by gussets 32 and longitudinal channels 33.

A number of first removable mould sections 34 are provided for interchangeable attachment to the mould assembly 23 in association with the first main mould section 27; and a number of second removable mould sections 35 are provided for interchangeable attachment to the mould assembly in association with the second main mould section 28. Each of the removable mould sections is mainly of spaced sheet metal channels reinforced by tubular reinforcing members 36 welded to the said channels and also to a pair of transverse beams 37 each of which is provided at both ends with pairs of apertured lugs 38 releasably connected by pins 39 to members 40 of the side frames 29 of the mould assembly 23. A first removable mould section 34 connected by the pins 39 to the mould assembly 23 forms, with the associated first main mould section 27, a complete first mould 41 for the casting of a concrete structure to be used as a roof section for a prefabricated building unit. In like manner, a second removable mould section 35 forms, with the associated second main mould section 28, a complete second mould 42 for the casting of a floor section for the prefabricated building unit. Four simple column moulds 43 are removably mounted on the mould assembly 23 for casting the columns for rigidly interconnecting the roof section to the floor section.

The sequence of operations for casting the concrete sections is shown in FIGS. 4 to 11.

Figure 4:
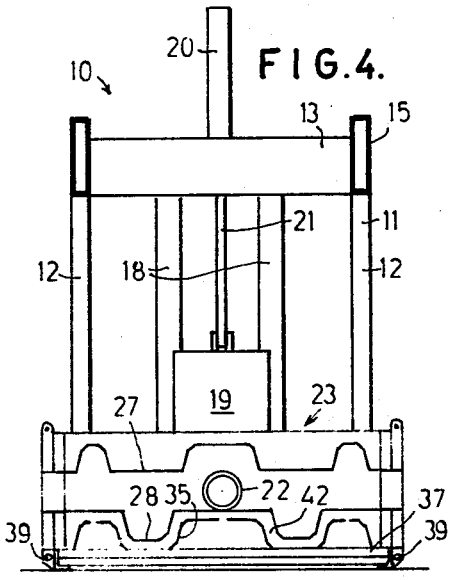

A second removable mould section 35 is laid upon the ground in inverted position and reinforcing steel mesh of usual type (not shown) is fitted thereon. The main frame 10 is moved laterally, the mould assembly 23 having first been raised by the hydraulic cylinders 20, until this mould assembly is positioned directly above the inverted second removable mould section 35, whereupon the mould assembly is lowered and pins 39 are inserted to lock the removable mould section 35 under the mould assembly 23, as shown in FIG. 4, completing the second mould 42.

Figure 5:
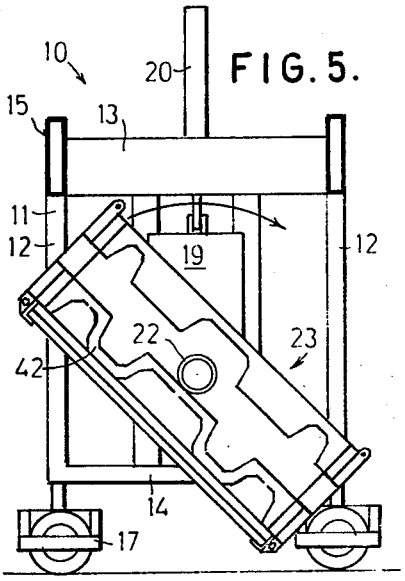

As shown in FIG. 5, the mould assembly 23 is then raised in parallelism, and is rotated in the direction shown by an arrow.

Figure 6:
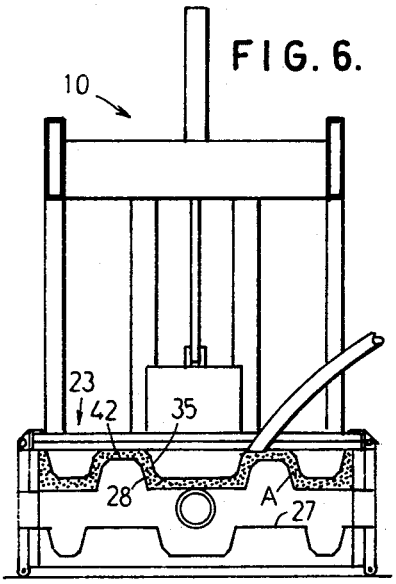

When, as shown in FIG. 6, the mould assembly 23 has been inverted or rotated through 180°, so that the complete second mould 42 is uppermost, the mould assembly is lowered, and concrete is fed by a chute into the second mould 42 through the various longitudinal openings between the channels of the second removable mould section 35 to cast a floor section A. The concrete is subjected to vibration in known manner, and the initial set period of the concrete begins.

Figure 7:
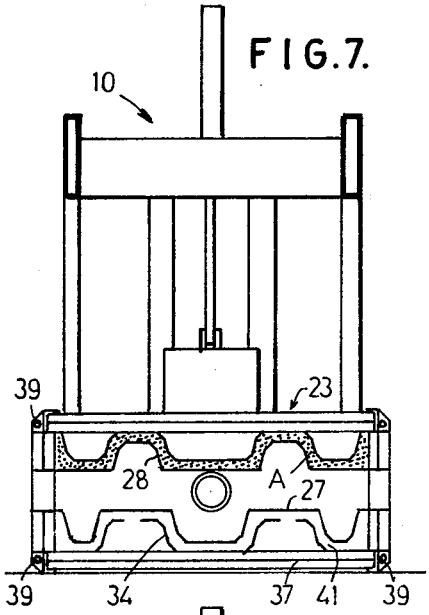

The mould assembly 23 is raised in parallelism, and the main frame 10 is again advanced laterally to bring the mould assembly directly over an inverted first removable mould section 34 to which reinforcing mesh is applied in usual manner, wherepon the mould assembly 23 is lowered and locked by pins 39 to the first removable mould section, to complete a first mould 41, as shown in FIG. 7. During this stage of the procedure, vacuum may be applied in known manner to the floor section A cast in the second mould 42, to accelerate setting. Vacuum means V is shown diagrammatically in FIG. 3.

Figure 8:
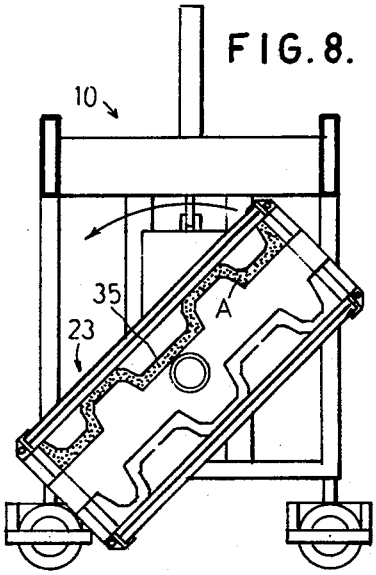

As shown in FIG. 8, the mould assembly 23 is again raised, and is swung in the direction shown by the arrow in this figure, in the reverse direction to that of FIG. 5.

Figure 9:
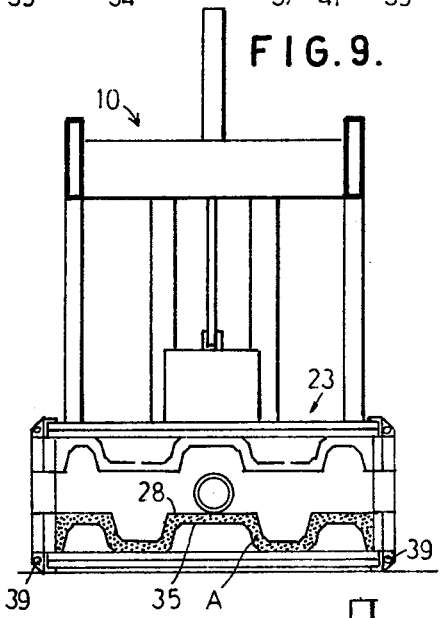

When the mould assembly 23 has been reversed, it is lowered, as shown in FIG. 9, so that the second removable mould section 35, supporting the cast article A, rests on the ground.

Figure 10:
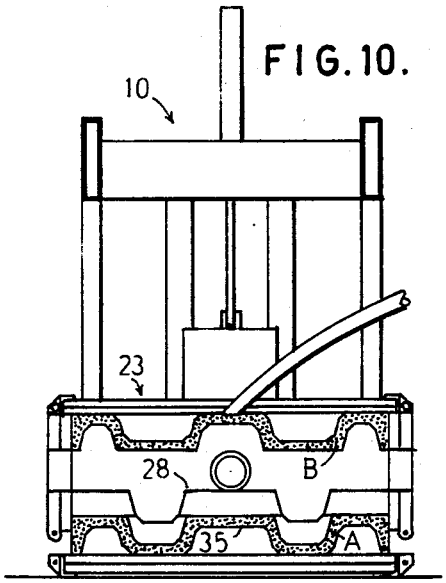

In FIG. 10 the lowermost pins 39 have been removed and the freed mould assembly 23 is then raised for a short distance to leave a space between the cast article A and the second main mould section 28. Steam may be passed through this space in known manner to accelerate the completion of the set of the article A. At the same time, concrete is fed into the now uppermost first mould 41 to cast a roof section unit B.

Figure 11:
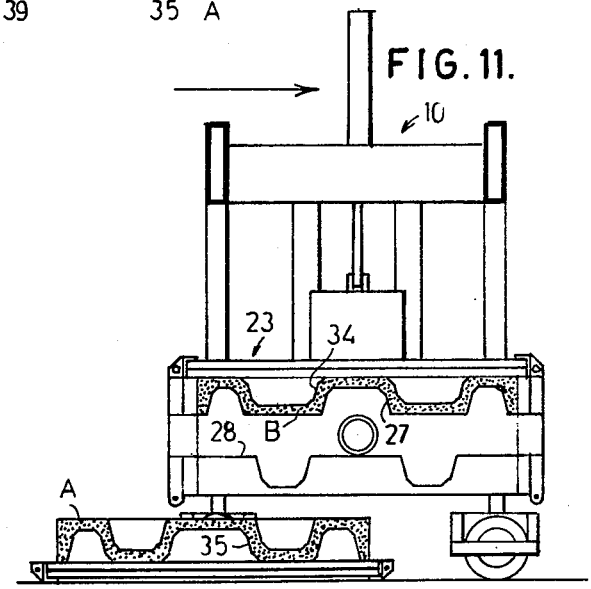

As shown in FIG. 11, the mould assembly 23 is then raised further to clear the cast article A, and the main frame 10 is moved laterally, in the direction shown in an arrow in this figure. The mould assembly 23 is thus brought over a further second removable mould section with reinforcing mesh applied. The procedure generally as before described in continued, a cast unit A or B being formed each time the appropriate complete mould is uppermost, and deposited, upon its removable mould section which serves as a pallet, after being brought to inverted position.

In this way, a series of cast units, alternatively of A and B type, are deposited fairly close together.

As each unit A or B is thus deposited, one or two columns, formed at the same time in a mould or moulds 43, are also formed and deposited, the columns mould 43 being located beyond the ends of the complete unit moulds 41 and 42.

For the purpose of steam treating the cast concrete articles, water may be stored and heated in tanks within the longitudinal members 15 of the main frame. The water in these tanks may be pre-heated by solar radiation, and conducted from the tanks to a boiler in which it is boiled, the steam being conducted by way of any suitable conduits to the longitudinal passages 31 of the mould assembly 23 and through perforations (not shown) to the cast articles. In FIG. 3, a water tank WB, boiler $B_1$, and a conduit C to the passage 31 are diagrammatically shown.

Instead of the mould assembly 23 being rotated in one direction or the other by the hydraulic cylinders 24, acting through the chain 25 and sprocket 26 on the pivot 22 of the assembly, this rotational movement may be brought about by gravity. If, for example, the parts of the apparatus are as shown in FIG. 7, with the floor section A cast in the uppermost second mould 42, and the mould assembly 23 is lifted, as shown in FIG. 8, then the assembly will turn gravitationally until the concrete casting A is lowermost, whereupon the mould assembly 23 may be lowered to the position shown in FIG. 9. Any suitable braking means are provided to control and to halt the rotational movement, with such braking means $B_2$ being shown diagrammatically in FIG. 1, operatively associated with the pivot 22.

I claim:

1. Apparatus for casting concrete articles including:

a main frame;

a mould assembly including a first main mould section, a first removable mould section attached to the main mould section to form with it a mould for articles to be cast, a second main mould section facing oppositely to the first main mould section so that when the one is in top position the other is in bottom inverted position, and a second removable mould section attached to the second main mould section to form with it a second mould for an article to be cast, each removable mould section being adapted, when the associated main mould section has been brought to bottom position and lowered onto a support, to be detached from said associated main mould section to serve as a pallet supporting an article cast in the such mould;

means mounting the mould assembly on the main frame for vertical movement and also for rotation about a substantially horizontal axis to bring said main mould assembly sections to a top position or to a bottom inverted position;

lifting means operatively associated with said frame for raising and lowering the mould assembly;

a water tank operatively mounted on the main frame;

a boiler operatively associated with said water tank to receive and boil water therefrom; and steam conduits operatively associated with said boiler for injecting steam from the boiler to articles cast in the moulds for steam curing thereof.

2. Apparatus according to claim 1 wherein:

the mould assembly is provided with a longitudinal central pivot, its end rotatably mounted in blocks vertically slidable in the main frame, said lifting means comprising hydraulic cylinders on the main frame adapted to raise or lower said blocks simultaneously.

3. Apparatus according to claim 1 wherein:

the main frame is wheel mounted for lateral movement relative to said substantially horizontal axis of rotation of said mould assembly.

4. Apparatus according to claim 1 further including: hydraulic means operatively associated with said frame for rotating and counter rotating the mould assembly to swing it through 180° in either direction.

5. Apparatus according to claim 1 further including: braking means operatively associated with said mounting means for controlling and for stopping rotational movement of the mould assembly.

6. Apparatus according to claim 1 wherein the steam conduits include longitudinal passages through the mould assembly, and openings leading from said passages to the moulds of the mould assembly.

7. Apparatus according to claim 1 further including: vacuum means operatively associated with the mould assembly to de-water the articles being cast to accelerate the setting of said articles.

* * * * *